United States Patent [19]

Carella

[11] 4,392,654

[45] Jul. 12, 1983

[54] ARROW FLETCHING

[76] Inventor: Richard F. Carella, 35572 Strathcona, Mount Clemens, Mich. 48043

[21] Appl. No.: 275,167

[22] Filed: Jun. 19, 1981

[51] Int. Cl.[3] ..... F41B 5/02

[52] U.S. Cl. ..... 273/423; 425/383; 264/145

[58] Field of Search ..... 273/420, 423

[56] References Cited

U.S. PATENT DOCUMENTS

| | | | |
|---|---|---|---|
| 1,648,376 | 11/1927 | Blodgett | 273/423 X |
| 2,193,397 | 3/1940 | Dykes . | |
| 2,277,743 | 3/1942 | Crossman . | |
| 2,525,332 | 10/1950 | Alger et al. . | |
| 3,106,400 | 10/1963 | Zwickey . | |
| 3,539,187 | 11/1970 | Smith . | |
| 3,595,579 | 7/1971 | Benolt . | |
| 3,749,403 | 7/1973 | Austin et al. . | |
| 3,756,602 | 9/1973 | Carella | 273/423 |
| 3,895,802 | 7/1975 | Bear . | |
| 4,003,576 | 1/1977 | Carella . | |
| 4,012,043 | 3/1977 | Carella | 273/423 |
| 4,088,323 | 5/1978 | Munger . | |

*Primary Examiner*—Paul E. Shapiro

*Attorney, Agent, or Firm*—Reising, Ethington, Barnard, Perry, Brooks & Milton

[57] ABSTRACT

Arrow fletchings (42, 102) disclosed have curved vanes (50, 114) inclined inwardly in a rearward direction to provide pockets (54, 118) for restricting air flow while allowing vane flexing in a manner that moderates drag in response to wind changes. One fletching embodiment (42) is preferably made by plastic extrusion and a subsequent heat forming process and includes a vane (50) whose inner portion projects radially from its foot (44) and whose outer portion define its curved pocket (54). Another fletching embodiment (102) made from sheet plastic includes a vane (114) that projects tangentially from the arrow shaft on which its foot (104) is mounted and is curved to define the pocket (118) that restricts air flow. A fixture (68) for heat forming the pocket of the one fletching embodiment (42) and a method for making the other fletching embodiment (102) are also disclosed.

15 Claims, 24 Drawing Figures

ARROW FLETCHING

TECHNICAL FIELD

This invention relates to the fletching of arrows.

BACKGROUND ART

Arrows conventionally include fletchings mounted on their rear ends to provide flight stability. Usually three and sometimes four fletchings are mounted in a circumferentially spaced relationship about the rear end of the arrow shaft. In addition, two fletchings and a single fletching have also been utilized on arrow shafts in the past but have never received any significant commercial acceptance by archers.

Feathers were the only type of fletchings conventionally utilized by archers until about five years or so ago when "rubber" fletchings gained acceptance. Actually, the designation "rubber" fletching is now somewhat of a misnomer since this type of fletching is presently made from synthetic plastic, although such plastic does have some rubber-like characteristics. Usually rubber fletchings are extruded with a mounting foot and a vane projecting from the foot, and the fletching is cut after the extrusion to the required length with the vane having the desired shape. In addition to feather and rubber fletchings, sheet plastic has also been previously utilized to make fletchings but has never received any significant commercial acceptance by archers.

Arrow spin or rotation is desirable to maintain flight stability and is usually achieved by mounting fletchings on the arrow shaft either at a slight angle with respect to the elongated axis thereof or in a helical configuration thereabout such that a screw action takes place during forward flight through the air. The consequent rotation stabilizes the arrow flight even when subjected to head, side, and tail winds that would otherwise significantly alter the flight trajectory. Such arrow rotation is particularly important with hunting arrows whose flat blade type points can tend to "sail" if there is not sufficient stabilizing rotation.

Prior art arrow fletchings of the type described above are illustrated by U.S. Pat. Nos.: 2,193,397; 2,277,743; 2,525,332, 3,106,400; 3,539,187; 3,595,579; 3,749,403; 3,895,802; 4,003,576; and 4,088,323.

My prior U.S. Pat. Nos. 3,756,602 and 4,012,043 disclose arrow fletchings made by sharply bending sheet plastic to the desired shape. The arrow fletching disclosed by my U.S. Pat. No. 3,756,602 includes vanes that are spaced outwardly from the shaft an increasing extent in the forward direction so as to provide a construction that compensates for cross-winds by steering the arrow into the wind. The arrow fletching disclosed by my U.S. Pat. No. 4,012,043 includes vanes that each define a pocket of decreasing volume from front to rear to effect a pressure buildup that causes stabilizing rotation of the arrow during flight.

Frictional drag generated by arrow fletchings during flight is affected by wind changes and thus alters the flight trajectory. Wind changes are a much greater problem with the longer distances involved in target shooting as compared to hunting, since any change in the frictional drag due to wind changes is effective over a greater period of time with the higher trajectory required for longer distances. Also, arrow fletchings heretofore have not had a construction capable of compensating for wind changes in order to maintain the desired flight trajectory.

DISCLOSURE OF INVENTION

An object of the present invention is to provide an improved arrow fletching of a construction that moderates drag in response to wind changes in order to maintain the desired flight trajectory.

In carrying out the above object and other objects of the invention, the arrow fletching comprises a foot adapted to mount the fletching on an arrow shaft and having front and rear ends spaced longitudinally along the shaft. A vane of the fletching projects from the foot and has a continuously curved shape that extends over a major portion of the projecting height of the vane from the foot and is inclined inwardly toward the foot in a rearward direction. The curved shape of the vane and its inward inclination in a rearward direction defines a pocket for restricting air flow while allowing the vane to flex in a manner that moderates drag in response to wind changes.

Flexing of the vane moderates drag in response to any change in the head or tail wind and, in addition, accommodates for any side wind changes.

An increase in head wind produces an increased pressure buildup in the curved vane pocket. Such pressure buildup flexes the vane outwardly to decrease the restriction of air flow and thereby decreases the frictional drag generated during flight such that the arrow does not fall short of its intented target. A decrease in the head wind decreases the pressure in the curved vane pocket. In response to this pressure decrease, the vane flexes inwardly to produce a greater restriction of air flow and thereby increases the frictional drag such that the arrow does not fly over the intended target.

A decrease in tail wind produces an increased pressure buildup in the curved vane pocket. Such pressure buildup flexes the vane outwardly to decrease the restriction of air flow and thereby decreases the frictional drag generated during flight such that the arrow does not fall short of its intended target. An increase in tail wind decreases the pressure in the curved vane pocket. In response to this pressure decrease, the vane flexes inwardly to produce a greater restriction of air flow and thereby increases the frictional drag such that the arrow does not fly over the intended target.

An increase in the side wind from either direction produces a greater extent of arrow rotation so that the axis of the arrow shaft does not move angularly with respect to the direction of flight and change the drag on the arrow as normally takes place with conventional arrows. Each vane flexes outwardly a slight extent as it is blown in the direction of the side wind to provide an increased rotational impetus, and each vane flexes inwardly a slight extent during movement into the side wind to facilitate the arrow rotation. This flexing thus increases the speed of arrow rotation as a result of increased side wind to increase flight stability. Any increase or decrease in side wind results in a corresponding change in the degree of vane flexing that takes place in response to such side wind change in order to moderate drag and thereby enhance flight stability along the desired trajectory.

Normally any change in head or tail wind is accompanied by a side wind change and the head or tail wind flexing then takes place concurrently with the side wind flexing as described above.

One embodiment of the arrow fletching includes a foot having an inwardly facing mounting surface and an outer side from which the vane projects radially. A front end of the vane projects radially throughout the extent thereof, and a rear end of the vane has an inner portion that projects radially from the foot and an outer portion that defines the curved pocket. This embodiment of the fletching is preferably made from plastic by initially extruding the foot and vane unitary with each other and then heat forming the vane to define the curved pocket.

Another embodiment of the fletching is made from sheet material such that the vane projects tangentially from an arrow shaft on which the foot is mounted. The sheet material is preferably plastic and has a curved cylindrical shape with the foot extending angularly with respect to the axial direction of the cylindrical shape so as to provide the inward inclination in a rearward direction of the curved vane with the fletching mounted on an associated arrow shaft. The foot is disclosed as having a straight terminal edge and the vane includes a curved terminal edge extending between the front and rear ends of the foot. In an unflexed condition, the cylindrical shape of the sheet plastic fletching extends circumferetially for less than 360 degrees about the cylindrical axis.

Both embodiments are disclosed on an associated arrow with the fletchings spaced circumferentially about the rear end of the arrow shaft. The foot of the fletching can be mounted parallel, angularly, or helically with respect to the shaft and, in each case, the inward inclination in a rearward direction of the curved shape of the vane produces the flexing that moderates drag in response to wind changes in order to maintain flight stability.

Another object of the present invention is to provide a fixture for use in heat forming a plastic arrow fletching. This fixture has particular utility with the fletching embodiment whose vane projects radially from the foot thereof and provides an economical and efficient way of heat forming the curved pocket of the vane.

The fixture includes a pair of clamp members that clamp the arrow fletching prior to the heat forming. A former of the fixture bends the clamped fletching to the curved shape desired. Upon heating and subsequent cooling, the fletching assumes the curved shape to which it is formed by the fixture.

In its preferred construction, the fixture comprises a fletching jig clamp whose clamp members have terminal edges for clamping a fletching vane adjacent the foot thereof such that the foot is exposed to permit mounting on an arrow shaft after the heat forming. One of the clamp members includes an opening through which the vane of the clamped fletching extends in the curved shape. The former is embodied by a forming member that is mounted within the clamp member opening to bend the fletching vane into the curved shape extending through the opening in preparation for the heating and cooling operation.

A further object of the present invention is to provide an improved method for making a curved arrow fletching from sheet plastic. The method disclosed has particular utility for making the fletching embodiment whose vane extends tangentially from the associated arrow shaft.

The method in accordance with the immediately preceding object is performed by bending a plastic sheet to a cylindrically curved shape. Heating of the cylindrically curved plastic sheet to a softened condition is followed by cooling such that the plastic sheet assumes the cylindrically curved shape. Thereafter, a curved arrow fletching is cut from the curved plastic sheet.

In the preferred practice of the method, the plastic sheet is bent around a mandrel that extends through a passage in which the heating and cooling are performed as the plastic sheet is moved through the passage. The heating is preferably performed electrically adjacent an upstream end of the passage where the plastic sheet initially enters the passage, and the cooling is performed fluidly adjacent a downstream end of the passage through which the plastic sheet leaves the passage.

The bending of the plastic sheet is performed to provide a generally tubular construction extending about the elongated direction thereof for more than 360 degrees in a slightly overlapping relationship. The curved plastic sheet is temporarily flattened after cooling and then die stamped to cut the fletching. The cutting is preferably performed to provide a cylindrically curved fletching with a foot that extends angularly to the axial direction of the cylindrical curvature in order to provide a curved pocket for restricting air flow.

The most efficient way of performing the method is by utilizing sheet plastic in a rolled strip that is initially unrolled prior to bending into a cylindrical shape about the mandrel that extends through the passage in which heating and cooling are performed. The strip is pulled through the passage and then temporarily flattened as the die stamping of the curved fletching is performed. After the die stamping, the cut fletching has a cylindrically curved shape that extends about the axial direction thereof for less than 360 degrees. The tubular construction of the plastic strip just after bending for more than 360 degrees and the resultant cylindrically curved shape of less than 360 degrees is a result of waste stock at each side of the strip in order to permit the strip to be pulled through the whole operation and is also a result of some loss in curvature during the temporary flattening.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
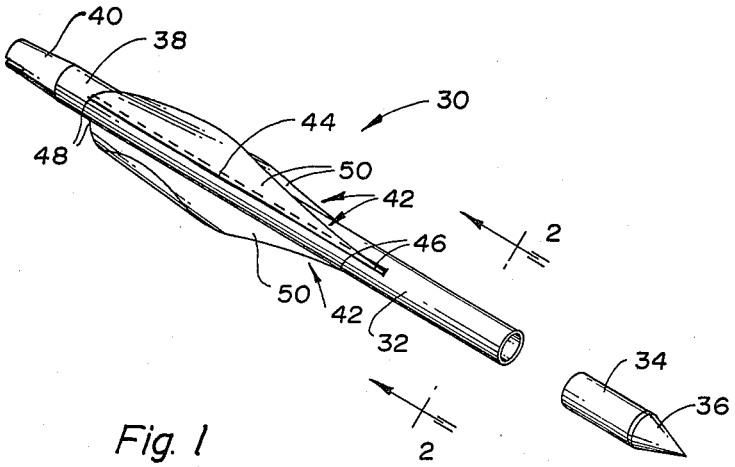
FIG. 1 is a partially broken away perspective view of an arrow including one embodiment of an arrow fletching constructed in accordance with the present invention.

Referring to FIG. 1 of the drawings, a partially broken away arrow generally indicated by reference numeral 30 includes an elongated shaft 32 having a front end 34 on which a point 36 is mounted and a rear end 38 on whose rearward extremity a nock 40 is mounted. Arrow 30 includes circumferentially spaced fletchings 42 constructed in accordance with the present invention to enhance flight stability as is hereinafter more fully described.

Figure 2:
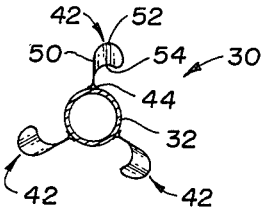
FIG. 2 is a sectional view through the arrow taken along line 2—2 of FIG. 1 and illustrating vanes of the fletchings in an unflexed condition.

As seen by combined reference to FIGS. 1 and 2, each arrow fletching 42 includes a foot 44 for mounting the fletching on the arrow shaft 32. Each fletching foot 44 includes front and rear ends 46 and 48 (FIG. 1) that are illustrated aligned longitudinally along the arrow shaft 32. It is also possible to mount the foot 44 of each fletching angularly or in a helical configuration on the arrow shaft to enhance rotation during flight. A vane 50 of each fletching 42 projects from the foot 44 thereof and has a continuously curved shape 52 that extends over a major portion of the projecting height of the vane from the foot. The curved shape 52 of the vane 50 is inclined inwardly toward the foot 44 in a rearward direction to define a pocket 54 for restricting air flow during flight. The construction of the fletching vane 50 is such that the vane flexes during flight to moderate drag in response to wind changes and thereby enhances flight stability along the desired trajectory.

Figure 9:
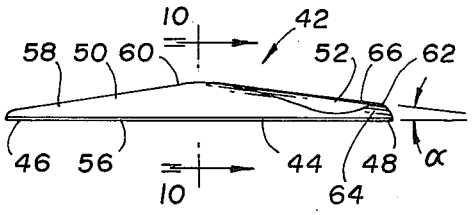
FIG. 9 is a side view of the fletching after heat forming thereof to include the curved pocket.
Figure 10:
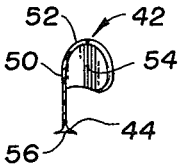
FIG. 10 is a sectional view through the fletching taken along line 10—10 of FIG. 9.

As seen in FIGS. 9 and 10, the foot 44 of fletching 42 has an inwardly facing mounting surface 56 for mounting the fletching on the arrow shaft by a suitable adhesive and also has an outer side from which the vane 50 projects radially. Fletching vane 50 includes a front end 58 (FIG. 9) that projects radially throughout the extent thereof between the foot 44 and the outer terminal edge 60 of the vane. Vane 50 includes a rear end 62 having an inner portion 64 that projects radially from the foot 44 and also having an outer portion 66 with the curved shape 52 defining the pocket that restricts air flow. The curved shape 52 is cylindrical about an axial direction that defines an angle $\alpha$ (FIG. 9) with the foot 44 so as to provide the inward inclination of the pocket in a rearward direction even with the foot aligned with the arrow shaft.

As is hereinafter more fully described, the fletching 42 is made from a plastic with somewhat rubber-like characteristics. Preferably, the fletching 42 is made with its foot 44 and vane 50 as a unitary extrusion and the vane is thereafter heat formed to define the curved pocket 54 which restricts air flow in a manner that moderates drag to enhance stability and flight along the desired trajectory.

Figure 3:
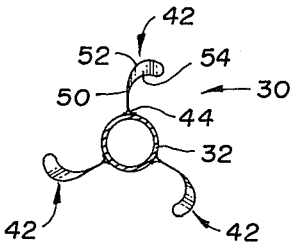
FIG. 3 is a view taken in the same direction as FIG. 2 but with the vanes of the fletchings partially flexed in an outward direction as would be the case during arrow flight in still air.
Figure 4:
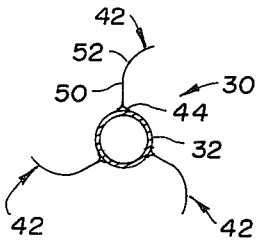
FIG. 4 is a view also taken in the same direction as FIG. 2 but illustrating the vanes of the fletchings fully flexed in an outward direction as would be the case during arrow flight into a strong head wind.

The manner in which fletchings 42 restrict air flow to moderate drag in response to wind changes will now be described by initially referring to FIG. 2 wherein the vanes 50 of the fletchings are illustrated in an unflexed condition such as is the case prior to flight. As the arrow is released, air flow rearwardly with respect to the arrow shaft 32 into the curved pocket 54 is restricted by the inward inclination of the pocket in a rearward direction. The restriction of the air flow generates a pressure buildup which rotates the arrow counterclockwise and also flexes the vane outwardly to a degree dependent upon the extent of the pressure buildup. With arrow flight through relatively still air, the fletching vanes 50 will be partially flexed in an outward direction such as illustrated in FIG. 3 where the remaining extent of the curved pocket 54 continues to restrict air flow a certain extent during flight. With a tail wind, the vanes 50 will be flexed inwardly from the FIG. 3 position toward the FIG. 2 position. In strong head winds, the fletching vanes fully flex in an outward direction as illustrated in FIG. 4 so as to lessen the drag and thereby prevent the arrow from falling short of its intended target.

Any wind change along the direction of arrow flight is accommodated for by flexing of the vanes 50 to moderate drag and thereby insure arrow flight stability along the desired trajectory. An increase in head wind or a decrease in tail wind results in increased pressure buildup at the curved pocket 54 of each vane in order to flex the vane outwardly and thereby decrease the drag so that the arrow does not fall short of its intended target. Similarly, a decrease in head wind or an increase in tail wind lessens the pressure buildup due to restricted air flow and thereby results in inward flexing of the vanes to increase the pressure buildup and the drag to insure that the arrow does not overshoot the intended target.

Fletching vanes 42 illustrated in FIGS. 1 through 4 also compensate for changes in side winds to moderate drag and thereby maintain the desired flight trajectory. Any increased side wind produces an increased extent of arrow rotation to prevent the rear end of the arrow from being blown in the direction of such side wind with respect to the front end and thereby creating a greater drag during flight. Each vane flexes outwardly a slight extent as it is blown in the direction of the side wind to provide an increased rotational impetus, and each vane flexes inwardly a slight extent during movement into the side wind to facilitate the arrow rotation. This flexing thus increases the extent of arrow rotation as a result of increased side wind to increase flight stability. Any increase or decrease in side wind results in a corresponding change in the degree of vane flexing that takes place in response to such side wind change in order to moderate drag and thereby enhance flight stability along the desired trajectory.

Figure 5:
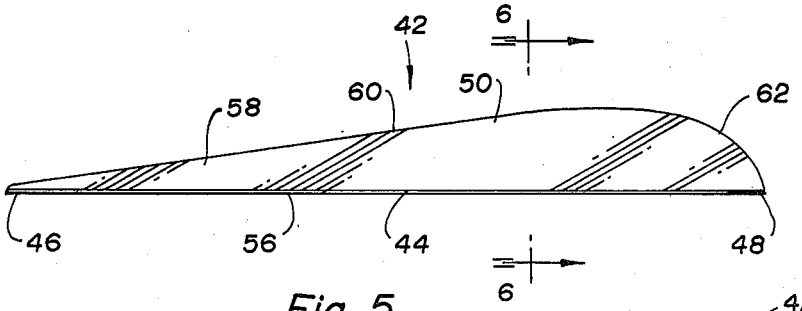
FIG. 5 is a side view of the arrow fletching illustrated in FIGS. 1 through 4 prior to forming of a curved pocket thereof which restricts air flow during flight.
Figure 6:
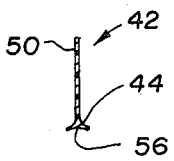
FIG. 6 is a sectional view of the fletching taken along line 6—6 of FIG. 5.

The fletchings 42 with the curved pockets as described above are made by initially extruding the fletching from a suitable plastic with the foot 44 and vane 50 extending therefrom as illustrated in FIGS. 5 and 6. The fletching is then cut to the desired length and shape. Fletchings with such a construction are commercially available and no further description thereof is thus necessary.

Figure 7:
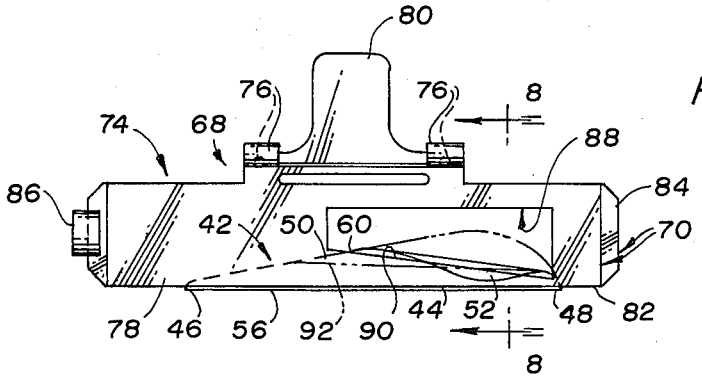
FIG. 7 is a side view of a fixture constructed in accordance with the present invention and used to heat form the curved pocket on the arrow fletching illustrated in FIGS. 5 and 6.
Figure 8:
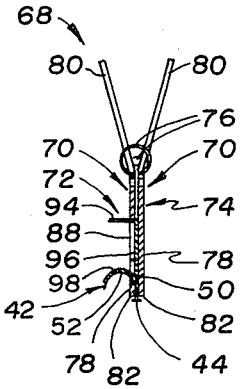
FIG. 8 is a sectional view taken through the fixture and illustrating a former that curves the fletching prior to a heating and cooling operation after which the fletching assumes the curved shape.

Referring to FIGS. 7 and 8, a fixture constructed in accordance with the present invention is indicated generally by reference numeral 68 and is used to heat form the curved pockets 54 in the arrow fletchings 42 described above. Fixture 68 includes a pair of clamp members 70 that clamp the arrow fletching in preparation for heat forming the curved pocket. A former generally indicated by 72 in FIG. 8 bends the clamped fletching 42 such that its vane 50 assumes the shape of the curved pocket. Thereafter, the clamped fletching in its curved shape is heated such as by merely placing the fixture 68 in an oven at a temperature on the order of about 300 degrees Fahrenheit for about 10 minutes to soften the plastic. After such heating, the fixture 68 is removed from the oven and upon subsequent cooling the fletching vane 50 assumes the curved shape 52 defining the curved pocket that is inclined inwardly in a rearward direction as illustrated in FIGS. 9 and 10.

Fixture 68 shown in FIGS. 7 and 8 preferably comprises a fletching jig clamp 74 whose two clamp members 70 are connected by a pair of ball-and-spring connections 76 that bias lower blades 78 of the clamp members toward each other. Between the connections 76, each clamp member 70 includes an upwardly extending handle 80 that is slightly inclined away from the plane of the associated blade 78 thereof to permit the handles 80 to be moved toward each other and thereby pivot the blades away from each other. Each of the clamp member blades 78 has a lower terminal edge 82 adjacent which the foot 44 of the clamped fletching 42 is exposed to permit mounting of the fletching on an arrow shaft after heat forming the curved pocket. As seen in FIG. 7, one of the blades 78 has a rear end 84 that mounts on the conventional indexer of a fletching jig and has a front end including a positioner 86 that mounts on the conventional angle positioner at the front end of a fletching jig. Between their front and rear ends, the clamp member blades 78 may have either a straight shape as illustrated for mounting the fletching parallel to the direction of the arrow or at any desired angular inclination with respect thereto or may have a curved shape for mounting the fletching in a helical configuration.

One of the clamp members 70 shown in FIGS. 7 and 8 includes a blade 78 having an opening 88 through which the vane 50 is bent into its curved shape 52 defining the pocket that restricts air flow. At its lower extremity, the opening 88 has an inclined edge 90 so as to provide the inward inclination of the curved pocket in a rearward direction. Inclined edge 90 defines an angle with the lower blade edge 82 equal to the angle $\alpha$ (FIG. 9) between the fletching foot 44 and the axial direction of pocket curvature. Preferably, the inner side of the blade 78 with the opening 88 has a curved taper from the phantom line 92 illustrated in FIG. 7 to the inclined edge 90 in order to make the pocket curvature less abrupt than would otherwise be the case.

The former 72 illustrated in FIG. 8 comprises a forming member made from thin metal stock with a shape that can be mounted within the clamp member opening 88 to bend the fletching vane 50 into its curved shape 52 extending through the opening in preparation for the heating and cooling that results in the vane assuming the curved shape. The forming member includes an upper handle 94 from which a vertical leg 96 extends downwardly to a curved forming portion 98 that engages the vane 50 to bend the vane into its curved shape through the opening 88 as discussed above. With this construction, the former 72 is separable from the clamp which first clamps the fletching 42 prior to insertion of the former into the opening 88 to bend the vane 50 to the curved shape for the heating and cooling that permanently curves the fletching vane.

Of course, the fletching 42 described above can be made other than by the extrusion and subsequent heat forming process described. For example, it is possible to injection mold the fletching vane 42 with the desired shape. However, the extrusion and subsequent heat forming process described is economical and effective especially when utilized with the fletching jig clamp 74 herein disclosed to permit mounting of the curved fletching on an arrow shaft after the heat forming operation.

Figure 11:
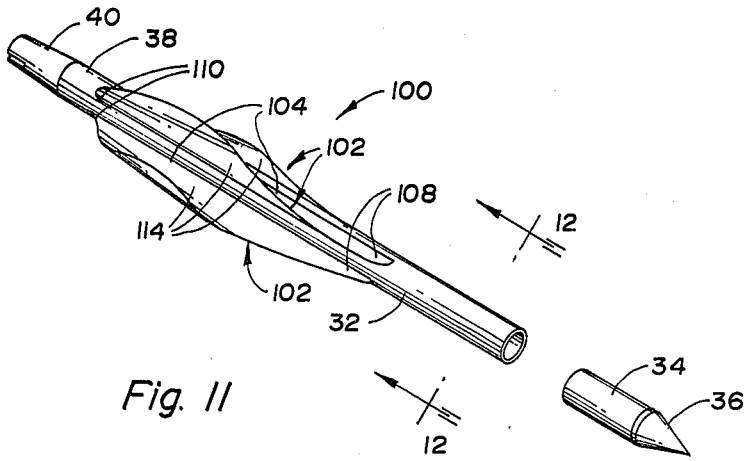
FIG. 11 is a partially broken away perspective view illustrating an arrow including another embodiment of a fletching constructed in accordance with the present invention.
Figure 22:
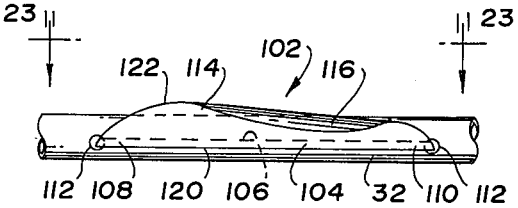
FIG. 22 is a side view of the arrow fletching of FIGS. 20 and 21 illustrated mounted on an arrow shaft viewed in a radial direction.
Figure 24:
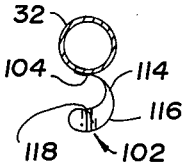
FIG. 24 is a sectional view taken along line 24—24 in FIG. 23 and illustrating the manner in which the mounted fletching restricts air flow.
Figure 23:
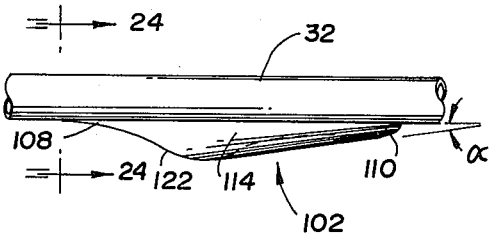
FIG. 23 is a view of the mounted arrow fletching taken along line 23—23 of FIG. 22.

Referring now to FIG. 11, an arrow indicated generally by 100 includes another embodiment of fletchings 102 in accordance with the present invention and mounted on the rear shaft end 38 spaced circumferentially from each other. As seen by additional reference to FIGS. 12 through 14 and 22 through 24, each fletching 102 includes a foot 104 that is mounted on the arrow shaft 32 preferably by a strip of double sided adhesive tape 106 illustrated in FIG. 22. The foot 104 has front and rear ends 108 and 110 whose connection to the arrow shaft 32 is preferably reinforced by drops of glue 112. A vane 114 of each fletching 102 projects from the foot 104 thereof and has a continuously curved shape 116 that extends over at least a major portion, and preferably over the entire extent, of the projecting height of the vane from the foot. The curved shape 116 of the vane 114 is inclined inwardly toward the foot in a rearward direction to define a pocket 118 for restricting air flow during flight. The curved shape 116 of the pocket 118 permits the vane to flex in order to moderate drag in response to wind changes to insure flight stability along the desired trajectory.

Figure 12:
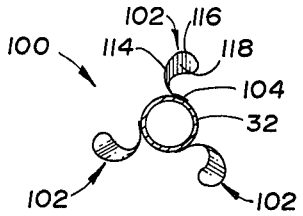
FIG. 12 is a sectional view taken through the arrow along line 12—12 of FIG. 11 and illustrating the vanes of the fletchings thereof in an unflexed condition such as is the case prior to flight.
Figure 13:
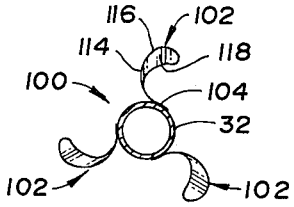
FIG. 13 is a sectional view through the arrow taken in the same direction as FIG. 12 but illustrating the vanes of the fletchings partially flexed in an outward direction such as is the case during arrow flight in still air.
Figure 14:
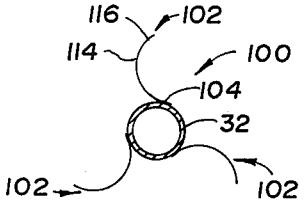
FIG. 14 is a sectional view of the arrow taken in the same direction as FIG. 12 but illustrating the vanes of the fletching fully flexed in an outward direction such as is the case during arrow flight into a strong head wind.

Fletchings 102 are made from sheet material such that the vanes 114 thereof project, as seen in FIGS. 12 through 14, tangentially from the arrow shaft 32 on which the foot 104 of each fletching is mounted. The sheet material from which the fletchings are made is a suitable plastic such as the polyester sold under the tradename Mylar and may be as thin as about 3 mils with the fletching construction herein disclosed.

Figure 16:
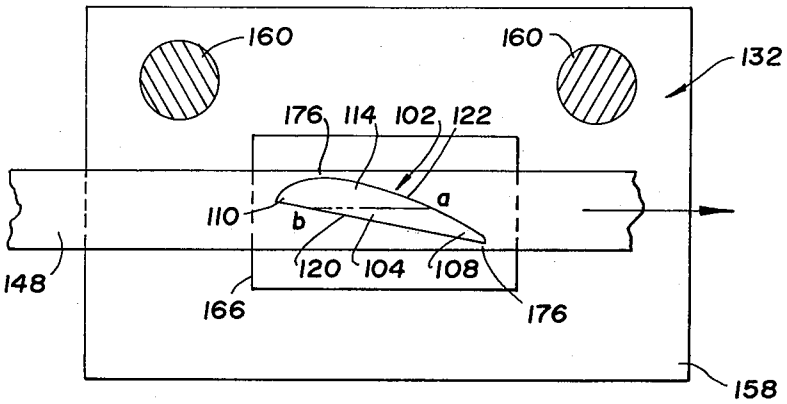
FIG. 16 is a top plan view taken along line 16—16 of FIG. 15 and illustrating the manner in which fletchings are die stamped from a strip of sheet plastic after an initial heating and cooling operation that cylindrically curves the strip.
Figure 20:
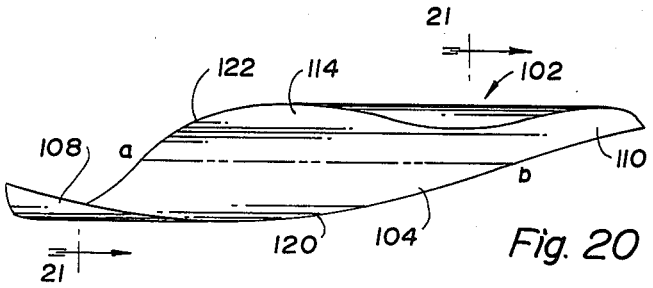
FIG. 20 is a side view of the type of arrow fletching illustrated in FIGS. 11 through 14 after manufacturing thereof in accordance with the method illustrated in FIGS. 15 through 19 and prior to mounting on an arrow shaft.
Figure 21:
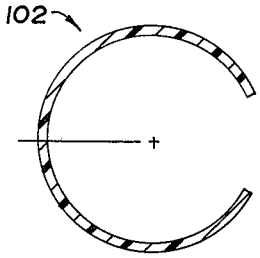
FIG. 21 is a view of the arrow fletching taken endwise with respect to the cylindrically curved shape thereof along line 21—21 of FIG. 20.

As seen in FIGS. 20 and 21, the fletching 102 has a curved cylindrical shape and the foot 104 thereof extends angularly with respect to the axial direction of the cylindrical shape. Such angularity provides the pocket with an axial direction of cylindrical curvature inclined at an angle $\alpha$ (FIG. 23) with the arrow shaft so as to restrict air flow even when the foot is aligned with the arrow shaft. As best seen in FIG. 16 which will be hereinafter more fully described, the fletching foot 104 includes a straight terminal edge 120 extending between the front and rear ends 108 and 110 thereof and the vane 114 includes a curved terminal edge 122 extending between the ends of the foot. The cylindrically curved shape 116 of the fletching vane 114 is formed by heating and cooling sheet plastic as is more fully hereinafter described.

The manner in which the curved vanes 114 of fletchings 102 flex to moderate drag in response to wind changes will now be described in connection with FIGS. 12 through 14. With initial reference to FIG. 12, the fletching vanes 114 are illustrated in an unflexed condition prior to flight showing the manner in which the curved pockets 118 face forwardly to restrict air flow and thereby generate a pressure buildup which rotates the arrow counterclockwise during flight. The restriction of air flow flexes the fletching vanes 114 outwardly in accordance with the extent of the pressure buildup and any wind change is accommodated for by inward or outward flexing to moderate drag and insure flight stability along the desired trajectory. In FIG. 13, the fletching vanes are illustrated partially flexed in an outward direction, such as is the case during arrow flight through still air, and still have the capability of flexing outwardly further as well as inwardly. With a tail wind, the vanes 114 will be flexed inwardly from the FIG. 13 position toward the FIG. 12 position. In FIG. 14, the fletching vanes 114 are illustrated fully flexed in an outward direction such as is the case during arrow flight into a strong head wind.

The curved shape 116 of each fletching vane 114 permits flexing between the extremes illustrated in FIGS. 12 and 14 to accommodate for drag in response to wind changes so as to insure flight stability along the desired trajectory. Any increase in head wind or decrease in tail wind is accommodated for by an increased pressure buildup within the curved pocket 118 of each flexing vane such that a resultant outward flexing in response thereto decreases the drag to prevent the arrow from falling short of its intended target. Similarly, a decrease in head wind or an increase in tail wind is accompanied by a decrease in the pressure buildup within each curved pocket 118 and consequent inward flexing of the curved vanes 114 in response thereto increases the drag so as to prevent the arrow from overshooting its intended target.

Flexing of vanes 114 of arrow fletchings 102 illustrated in FIGS. 12 through 14 also accommodates for changes in side wind. An increased side wind in either direction produces an increased arrow rotation that increases flight stability to prevent the rear end of the arrow from being blown in the direction of the side wind with respect to the front end thereof and consequent arrow flight angularly through the air in a manner that generates an increased frictional drag. Side wind from either direction flexes each vane 114 outwardly during the portion of angular rotation with the side wind. Such outward flexing presents a greater vane area to the side wind and thereby produces a greater impetus for rotating the arrow. Each fletching vane 114 flexes inwardly during the portion of angular rotation into the side wind to decrease the resistance to the arrow rotation. Any increase or decrease in side wind from either direction thus is accommodated for by flexing of the curved vanes 114 to moderate drag and thereby provide flight stability along the desired trajectory.

Figure 15:
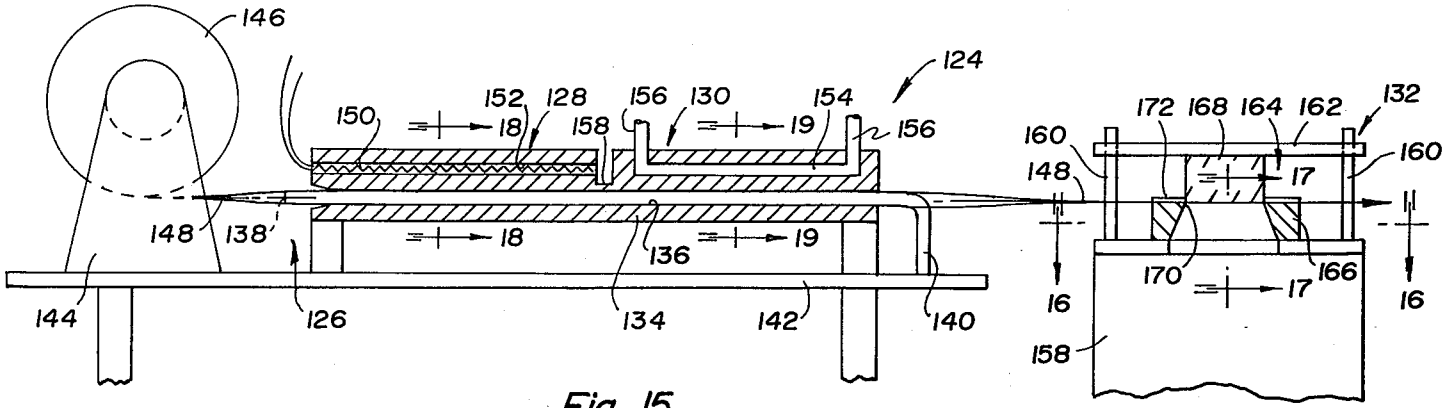
FIG. 15 is a partially sectioned side elevation view of apparatus for making the arrow fletchings illustrated in FIGS. 11 through 14 from sheet plastic in accordance with a method of the present invention.

Apparatus 124 illustrated in FIG. 15 is utilized to perform a method for making the curved arrow fletchings 102 in accordance with the present invention. During operation, apparatus 124 initially bends sheet plastic to a cylindrically curved shape at a bending station 126. Thereafter, a heating station 128 of the apparatus heats the bent plastic sheet to a softened condition and a cooling station 130 then cools the plastic sheet so as to maintain the curvature. A final cutting operation preferably performed by a die stamping machine 132 completes the manufacturing of the curved arrow fletching 102 from the curved plastic sheet.

Figure 18:
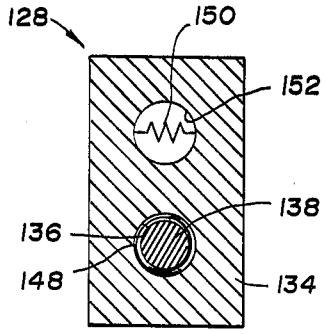
FIG. 18 is a sectional view taken along line 18—18 of FIG. 15 and illustrating the manner in which the sheet plastic strip is cylindrically bent around a mandrel and electrically heated in this shape during movement within a passage through which the mandrel extends.
Figure 19:
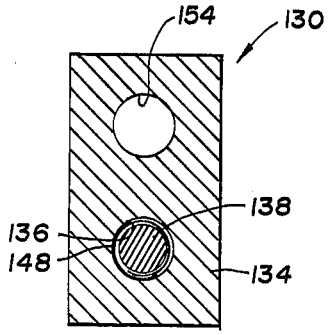
FIG. 19 is a sectional view taken along line 19—19 in FIG. 15 and illustrating the manner in which the cylindrically bent sheet plastic strip is fluidly cooled so as to assume the curved shape.

With combined reference to FIGS. 15, 18, and 19, the apparatus 124 includes an elongated member 134 defining a passage 136 through the heating and cooling stations 128 and 130. A mandrel 138 of the apparatus extends through the passage 136 and has a support leg 140 mounted by a base 142 at the downstream end of the cooling station 130. At the upstream end of the heating station 128, a support 144 on the base 142 mounts a roll 146 of sheet plastic in the form of a strip 148. During operation, the strip 148 is pulled toward the right from the downstream end of the die stamping machine 132. Such pulling initially unrolls and bends the sheet plastic strip 148 around the mandrel 138 that extends through the passage 136 in which the heating and cooling are performed as the sheet plastic strip is moved toward the right through the passage.

As seen in FIG. 18, the sheet plastic strip 148 is initially bent to a generally tubular construction around mandrel 138 which has a diameter just slightly smaller than the passage 136. The tubular construction of the cylindrically bent plastic strip extends about the elongated direction thereof for more than 360 degrees so as to overlap itself a smaller extent. Electrical heating of the sheet plastic strip is preferably utilized as illustrated by the schematically indicated resistance heater 150 within a bore 152 located above the passage 136 through which the plastic strip is moved.

As seen by combined reference to FIGS. 15 and 19, the member 134 includes a cooling passage 154 above passage 136 at the cooling station 130. Cooling fluid is supplied to one of the ends 156 of cooling passage 154 and exits through its other end to provide the cooling of the bent plastic strip in order to permanently assume a curved shape. It will be noted that the member 134 includes a recess 158 to decrease heat transfer between the heating and cooling stations 128 and 130.

Figure 17:
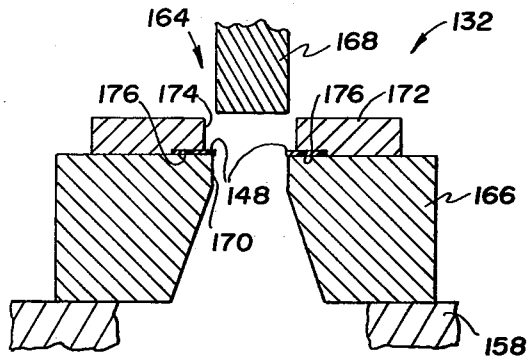
FIG. 17 is an elevation view taken in section along line 17—17 of FIG. 15 and illustrating the manner in which the curved plastic strip is temporarily flattened and die stamped to cut the fletching.

The die stamping machine 132 of the apparatus is illustrated in FIGS. 15 through 17 and includes a lower base 158 supporting upwardly extending guides 160 on which a vertically movable stamping head 162 is mounted. A die set 164 illustrated in FIGS. 15 and 17 includes a lower female die 166 mounted on the base 158 and also includes an upper punch die 168 mounted on the vertically movable head 162. The lower female die 156 includes an opening 170 that receives the upper punch die 168 upon downward movement. Female die opening 170 and the male punch die 168 have shapes corresponding to the shape of the fletching 102 as illustrated in FIG. 16. A flattening member 172 (FIG. 17) mounted on the lower female die 166 includes an aperture 174 of a slightly larger size than the die opening 170 and includes recesses 176 that receive the edges of the plastic strip 148 to temporarily flatten the plastic strip as the cutting is performed to the shape of the fletching 102 illustrated in FIG. 16.

As seen in FIG. 16, each lateral side of the plastic strip 148 includes waste stock 176 between the adjacent edge and the fletching 102 so as to permit the strip to be pulled toward the right through the apparatus. This waste stock and a certain degree of unbending that takes place during the temporary flattening accounts for the greater than 360 degree curvature of the tubular construction as the plastic strip is heated and cooled and the less than 360 degree curvature of the fletching after being die stamped to its final shape.

Phantom line a-b in FIG. 16 along the fletching 102 extends parallel to the direction of cylindrical curvature of the fletching approximately midway between its lateral extremes as viewed in this direction. The cut fletching as illustrated in FIG. 20 has a cylindrical shape with its straight foot edge 120 extending angularly to the phantom line a-b such that bending of the fletching is necessary for mounting on the arrow shaft 32 as illustrated in FIGS. 11 through 14 and 22 through 24. Upon such mounting, the foot edge 120 may be mounted parallel to the elongated direction of the arrow shaft or angularly with respect thereto if increased spin is desired such as is usually the case with hunting arrows. The unbending of the fletching 102 upon mounting provides the inward inclination in a rearward direction of the curved pocket 118 and also prestresses the fletching a certain extent such that thinner sheet plastic can be utilized than would otherwise be the case. As previously mentioned, sheet plastic on the order of 3 mils has been found to have adequate strength with the construction disclosed.

It should be mentioned that both embodiments of the fletchings herein disclosed are illustrated with curvature that produces rotation in the direction most right-handed archers use. However, curvature in the opposite direction can also be utilized to produce rotation in the opposite direction most left-handed archers use.

While best modes for practicing the invention have herein been described in detail, those familiar with the art to which this invention relates will recognize various alternate ways of carrying out the invention as defined by the following claims.

What is claimed is:

1. An arrow fletching comprising: a foot adapted to mount the fletching on an arrow shaft and having front and rear ends; and a flexible vane projecting from the foot and having a continuously curved shape over a major portion of the projecting height thereof from the foot, said curved shape of the vane being inclined inwardly toward the foot in a rearward direction to define a pocket for restricting air flow such that the vane flexes to moderate drag in response to wind changes.

2. A fletching as in claim 1 whose foot has an inwardly facing mounting surface and an outer side from which the vane projects radially.

3. A fletching as in claim 2 wherein the vane includes a front end that projects radially throughout the extent thereof, and the vane also including a rear end having an inner portion that projects radially from the foot and an outer portion that defines the curved pocket.

4. A fletching as in claim 1, 2 or 3 made from plastic.

5. A fletching as in claim 4 whose foot and vane are made as a unitary extrusion and whose vane is thereafter heat formed to define the curved pocket.

6. A fletching as in claim 1 made from sheet material.

7. A fletching as in claim 6 wherein the sheet material is plastic having a curved cylindrical shape and the foot extending angularly with respect to the axial direction of the cylindrical shape.

8. A fletching as in claim 7 wherein the foot includes a straight terminal edge and the vane includes a curved terminal edge.

9. A fletching as in claim 7 or 8 having an unflexed condition extending circumferentially in the cylindrical shape for less than 360 degrees.

10. An arrow fletching of a unitary plastic construction comprising: a foot adapted to mount the fletching on an arrow shaft and having front and rear ends; a flexible vane that projects radially from the foot and having an outer part of continuously curved shape extending over a major portion of the projecting height thereof from the foot, said curved shape of the vane being inclined inwardly toward the foot in a rearward direction to define a pocket for restricting air flow such that the vane flexes to moderate drag in response to wind changes.

11. An arrow including a shaft having front and rear ends and a plurality of fletchings mounted on the rear end spaced circumferentially about the shaft from each other, each fletching being of a unitary plastic construction comprising: a foot mounted on the rear end of the arrow shaft and having front and rear ends; a flexible vane that projects radially from the foot; the vane having a front end that projects radially throughout the extent thereof; and the vane having a rear end including an inner portion that projects radially from the foot and an outer portion having a continuously curved shape over a major portion of the radially projecting height thereof from the foot, said curved shape of the vane being inclined inwardly toward the foot in a rearward direction to define a pocket for restricting air flow such that the vane flexes to moderate drag in response to wind changes.

12. An arrow including a shaft having front and rear ends and a plurality of fletchings mounted on the rear end spaced circumferentially about the shaft from each other, each fletching being of a unitary extruded plastic construction comprising: a foot having front and rear ends and including an inwardly facing mounting surface mounted on the rear end of the arrow shaft; a flexible vane that projects radially from the foot; the vane having a front end that projects radially throughout the extent thereof; and the vane having a rear end including an inner portion that projects radially from the foot and an outer portion that is heat formed with a continuously curved shape over a major portion of the radially projecting height thereof from the foot, said curved shape of the vane being inclined inwardly toward the foot in a rearward direction to define a pocket for restricting air flow such that the vane flexes to moderate drag in response to wind changes.

13. An arrow fletching made from sheet plastic and having a unitary construction comprising: a foot adapted to mount the fletching on an arrow shaft; a flexible vane that projects from the foot tangentially with respect to the associated arrow shaft; and the vane having a continuously curved cylindrical shape over a major portion of the projecting height thereof from the foot, said curved cylindrical shape of the vane being inclined inwardly toward the foot in a rearward direction to define a pocket for restricting air flow such that the vane flexes to moderate drag in response to wind changes.

14. An arrow including a shaft having front and rear ends and a plurality of fletchings mounted on the rear end spaced circumferentially about the shaft from each other, each fletching being made from sheet plastic and having a unitary construction comprising: a foot that mounts the fletching on the arrow shaft; a flexible vane that projects from the foot tangentially with respect to the arrow shaft; the fletching having a continuously curved cylindrical shape over a major portion of the projecting height thereof from the foot; and the foot extending angularly with respect to the axial direction of the cylindrically curved shape such that the vane defines a pocket that is inclined inwardly toward the foot in a rearward direction to restrict air flow whereby the vane flexes to moderate drag in response to wind changes.

15. An arrow including a shaft having front and rear ends and a plurality of fletchings mounted on the rear end spaced circumferentially about the shaft from each other, each fletching being made from sheet plastic and having a unitary construction comprising: a foot that mounts the fletching on the arrow shaft; a flexible vane that projects from the foot tangentially with respect to the arrow shaft and has a curved terminal edge; the fletching having a continuously curved cylindrical shape over the entire extent of the projecting height thereof from the foot; said curved cylindrical shape of the vane being formed by heating and cooling the sheet plastic; and the foot having a straight terminal edge that extends angularly with respect to the axial direction of the cylindrically curved shape such that the vane defines a pocket that is inclined inwardly toward the foot in a rearward direction to restrict air flow whereby the vane flexes to moderate drag in response to wind changes.

* * * * *